US009366093B2

(12) United States Patent
McMiles

(10) Patent No.: US 9,366,093 B2
(45) Date of Patent: Jun. 14, 2016

(54) PIPE CONNECTOR

(75) Inventor: Barry J McMiles, Houston, TX (US)

(73) Assignee: The Subsea Company, Houston, TX (US)

( * ) Notice: Subject to any disclaimer, the term of this patent is extended or adjusted under 35 U.S.C. 154(b) by 710 days.

(21) Appl. No.: 13/320,066

(22) PCT Filed: Sep. 30, 2011

(86) PCT No.: PCT/US2011/054113

§ 371 (c)(1), (2), (4) Date: Nov. 11, 2011

(87) PCT Pub. No.: WO2012/047739

PCT Pub. Date: Apr. 12, 2012

(65) Prior Publication Data

US 2012/0153609 A1 Jun. 21, 2012

Related U.S. Application Data

(60) Provisional application No. 61/389,869, filed on Oct. 5, 2010.

(51) Int. Cl.
*F16L 37/18* (2006.01)
*E21B 17/046* (2006.01)

(52) U.S. Cl.
CPC ..... *E21B 17/046* (2013.01)

(58) Field of Classification Search
USPC ..... 285/314, 346, 403, 404, 394, 920, 39
See application file for complete search history.

(56) References Cited

U.S. PATENT DOCUMENTS

| | | | | |
|---|---|---|---|---|
| 239,827 | A | 4/1881 | Newman | |
| 2,950,132 | A | 8/1960 | Kocsuta | |
| 3,381,983 | A * | 5/1968 | Hanes | 285/321 |
| 3,420,554 | A | 1/1969 | Straub | |
| 3,521,911 | A * | 7/1970 | Hanes et al. | 285/27 |
| 3,888,520 | A | 6/1975 | Brennan | |
| 3,902,743 | A * | 9/1975 | Martin | 285/39 |
| 4,209,193 | A | 6/1980 | Ahlstone | |
| 4,491,346 | A | 1/1985 | Walker | |
| 4,830,408 | A | 5/1989 | Reimert | |
| 5,158,407 | A * | 10/1992 | Zettl | 409/234 |
| 7,798,208 | B2 * | 9/2010 | Purkis | 166/75.14 |
| 2008/0007057 | A1 | 1/2008 | Schmuck | |
| 2008/0100062 | A1 | 5/2008 | Aston | |

FOREIGN PATENT DOCUMENTS

| | | |
|---|---|---|
| EP | 0300829 | 1/1989 |

* cited by examiner

*Primary Examiner* — Aaron Dunwoody
(74) *Attorney, Agent, or Firm* — The Petruzzi Law Firm; James D. Petruzzi

(57) ABSTRACT

A two part coupling connector for pipe having male and female components that sealably engage with an extendable multi-link spring member that is locked into a recessed slot in the female component by a rotational key. The male and female components are aligned with a mating extension and receiving groove. The parts are disengaged by insertion of a tool into circumferential apertures about the female component that apply pressure inward to move the extendable spring away from the recessed slot. The connector may also have ports for communication and control lines that are engaged to and about the coupling connector to facilitate transmission of electrical signals and flanges to support such lines.

20 Claims, 3 Drawing Sheets

PIPE CONNECTOR

CROSS REFERENCE TO RELATED APPLICATIONS

This application is based on provisional patent application No. 61/389,869 entitled "Pipe Connector" filed on Oct. 5, 2010, which is hereby incorporated by reference as if fully set forth herein.

BACKGROUND OF THE INVENTION

This invention relates generally to the field of deep sea drilling and more specifically to a pipe connector for engaging drilling pipe.

Numerous coupling devices for oilfield applications include a variety of safety mechanisms. While most generally include a simple threading device included with a gasket material used to ensure that pressure is maintained at a joint, others simple rely on threading alone. Coupling devices providing for the union of joints often require repeated service due to the sealing, unsealing, joining, and release of a metal to polymer connection. Often risers and other pipes employed to carry fluid use simple connections which generally rely on threading alone.

While threading is beneficial, simple to manufacture, and does not interfere with fluid flow, numerous disadvantages do exist. In instances where a male component is not fully secured to a female component, the potential for the union binding the two joints to free itself is possible. In applications where a gap exists between the male and female union of the threading, yet the sealing has properly occurred, eddies can form and fluid can be sent into the gap between the two, causing deterioration when corrosive fluids are used.

While present sealing mechanisms do function, the union of pipe and the usage of polymer based sealing materials (for ease of combination and removal at the joint) often allows the sealing mechanism to expand into portions where fluids are flowing. This is problematic because even the smallest portions of foreign materials and debris can lead to catastrophic consequences once fluid is sent downhole.

Thus there exists a need for a coupling mechanism that can allow for the union of male and female joints, while allowing for ease of removal and reuse.

BRIEF SUMMARY OF THE INVENTION

The primary advantage of the invention is to provide an improved coupling device that is easily disengaged.

Another advantage of the invention is to provide a coupling device with a secure engagement and seal.

Another advantage of the invention is to provide a notched mating between two engageable members for coupling riser pipe.

Another advantage of the invention is to provide an expandable seal that is easily retracted for disengagement of two members.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is shown a coupling mechanism for engaging two or more annular components having a male component with a first central annular member, an extendable seal about the annular member, the seal having first and second ends, a female component having a second central annular member, a receiving slot on the inside diameter of the second annular member for the extendable seal, a rotatable lock that engages the first and second ends for extension of the seal into the receiving slot, and at least one mating tab in the male component on the outer annulus of the component that reciprocally engages a second receiving slot on the inside diameter of the second central annular member of the female component.

In accordance with another preferred embodiment of the invention, there is shown a coupling mechanism for engaging two or more annular components having a male component with a first central annular member, one or more first sub-annular members, and, one or more engaging components, and a female component having a second central annular member, one or more second sub-annular members, a rotatable cam that can activate the one or more engaging components; and one or more apertures disposed about the second central annular member wherein the male component and the female component can disengage one another via insertion of a member into the one or more apertures to release the female component from the male component.

In accordance with another preferred embodiment of the invention, there is shown a coupling mechanism for engaging two or more annular components having a male annular component with an annulus and an extendable spring about the outer diameter of the annulus, the spring having first and second ends, a female annular component for receiving the male member having a receiving slot on the inside diameter of the female annular member for the extendable spring, a rotatable lock on the female member that engages the first and second ends of the spring for extension of the spring into the receiving slot, and at least one tab on the male member that engages a mating groove on the female member for stable alignment of the two components.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Figure 1:
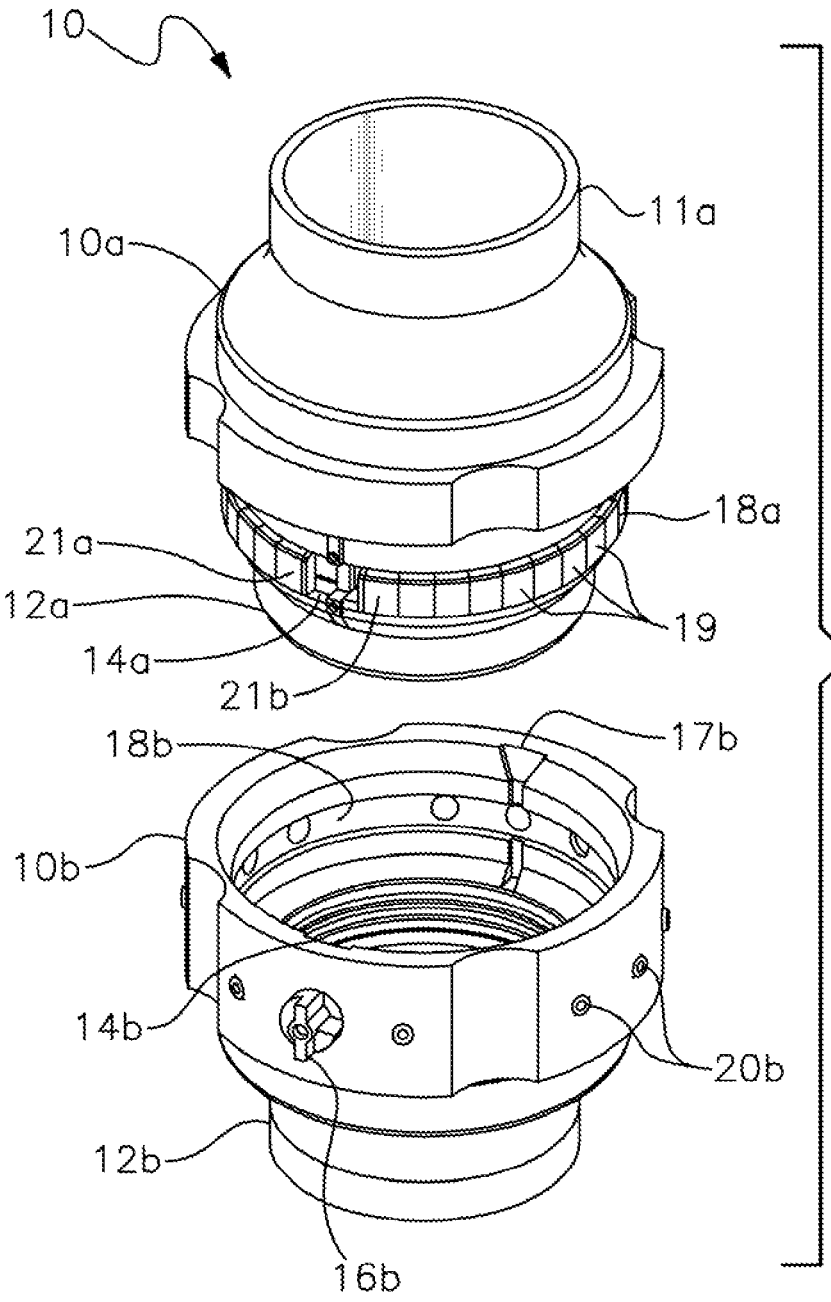
FIG. 1 shows a perspective view of a two part pipe connector according to a preferred embodiment of the invention.

Referring now to FIG. 1, a coupling mechanism 10, having a male component 10*a* and a female component 10*b*, is illustrated. In a preferred embodiment, components 10*a* and 10*b* would each be fixedly joined to drill pipe for mateable engagement of one pipe to another. Male component 10*a* would be welded or otherwise fixedly joined to pipe on the upper cylindrical portion 11*a* and female component 10*b* would similarly be fixedly joined to pipe on the lower cylindrical extension 12*b*. Male component 10*a* includes a male portion for aligning with a female component 10*b*. Male component 10*a* includes cylindrical portion 12*a*, receiving portion 14*a*, and seal member 18*a*. Seal member 18*a* preferably is composed of a plurality of interconnected jointed subsections 19 that unite to form a ring about the circumference of male component 10*a*. Female component 10*b* includes lower cylindrical extension 12*b*, grooved portion 14*b*, locking member 16*b*, receiving channel 18*b* and retractable tabs 20*b*. Male component 10*a* can couple to female component 10*b* as further described below. Receiving portion 14*a* corresponds to grooved portion 14*b*. Grooved portion 14*b* may have a V-shaped first portion above a rectilinear portion for reception and stable engagement of the extension. Locking member 16*b* can couple to male component 10*a*.

As is readily apparent, seal member 18*a* may be configured in a variety of ways including a single expandable section that upon pressure bows outward sufficiently to receiving channel 18*b* and provide stable engagement. In some embodiments, it may be a conventional coiled spring or other spring and may be further joined by a rubber seal or other sealing mechanism to prevent fluid leakage. Seal member 18*a* is shown here preferably with jointed subsections 19 that permit circumferential engagement with male component 10*a*. Seal member 18*a* may be releasably attached to male member 10*a*, or in other embodiments simply configured to stably engage around the surface of male member 10*a*.

In order to allow male member 10*a* to mate with female member 10*b*, cylindrical portion 12*a* must align with lower cylindrical extension 12*b*. Cylindrical portion 12*a* should align with lower cylindrical extension 12*b* to allow for proper fluid transmission via coupling mechanism 10. Once seal member 18*a* has properly aligned with the grooves of receiving channel 18*b*, assurance can be provided that sealing portions are ready to engage seal members 18*a* in a circumferential manner. After male component 10*a* and female component 10*b* have aligned with one another such that receiving portion 14*a* is aligned with grooved portion 14*b*, rotating member 16*b* can be turned to secure male component 10*a* to female component 10*b*. To provide further alignment of male member 10*a* to female member 10*b*, in a preferred embodiment a second grooved portion 17*b* positioned opposite first grooved portion 14*b* may receive a second mating protrusion (not shown) for stable engagement of male component 10*a* to female component 10*b*. Mating protrusion 17*a* shown in FIG. 2 mateably engages with second grooved portion 17*b* for stable engagement. As seen with receiving portion 14*a* and mating protrusion 17*a*, a space is provided for seal member 18*a* to encircle male component 10*a*. As locking member 16*b* turns, an extension portion 15, shown in FIG. 2, collaborates with seal member 18*a*, to expand into a void of receiving portion 18*b*. As a result of locking member 16*b* collaborating with receiving portion 14*b* and engaging first end 21*a* and second end 21*b* of seal member 18*a*, seal member 18*a* expands into receiving channel 18*b*, thereby locking the two sections together and preventing fluid from escaping from the union of male component 10*a* and female component 10*b*.

Figure 2:
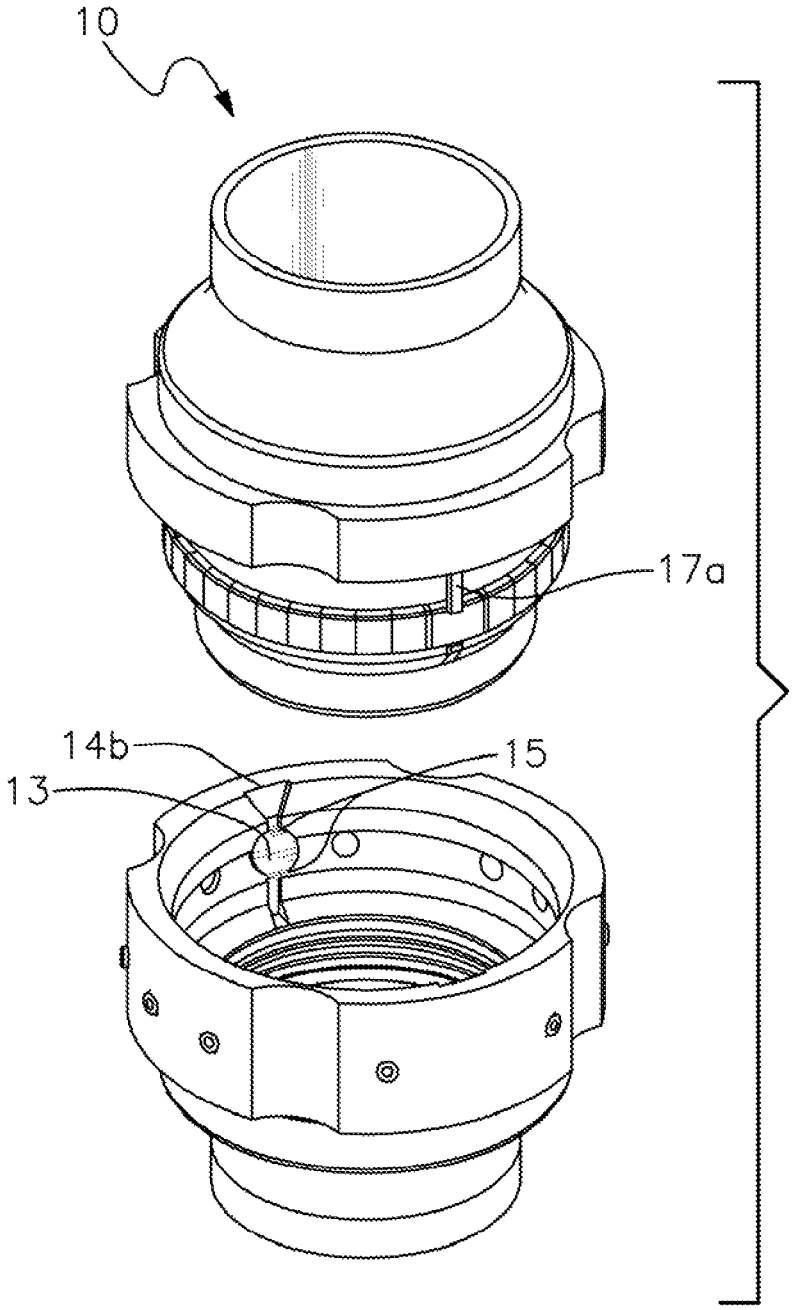
FIG. 2 shows a perspective view of a two part pipe connector according to a preferred embodiment of the invention from the opposite side as shown in FIG. 1.

FIG. 2 shows the opposite side of locking member 16*b* having lock 13 and extensions 15. As locking member 16*b* is turned, lock 13 is rotated and extension portions 15 are forced into the ends of seal member 18*a* at first end 21*a* and second end 21*b* thus spreading seal member 18*a* outward into receiving channel 18*b*. Extension portion 15 may be of a variety of configurations including each being a half circle or cam-type shape so as to engage first and second ends of seal member 18*a* and upon rotation, push outward on seal member 18*a*.

Locking member 16*b* engages the first end 21*a* and second end 21*b* of seal member 18*a* such that by turning locking member 16*b* clockwise, pressure is applied to first end 21*a* and second end 21*b* of seal member 18*a* at links thereby extending seal member 18*a* into receiving portion 18*b*. Once engaged, male component 10*a* and female component 10*b* are sealably and fixedly engaged. Such a mechanism can withstand tremendous pressure since the forces acting in the pipe are transverse to the locking member 16*b* and its engagement to seal member 18*a*.

To disengage male component 10*a* and female component 10*b*, locking member 16*b* is rotated in the opposite direction from its first position to relax pressure on first end 21*a* and second end 21*b* of seal member 18*a*, and then a cylindrical mechanism (not shown) can be inserted into retractable tabs 20*b* which in turn acts to drive individual seal members 18*a* into a collapsed or relaxed position such that male component 10*a* can be removed from female component 10*b*. Once all jointed subsections 19 are disengaged from receiving channel 18*b*, male component 10*a* can be removed from female component 10*b*, via alignment with receiving portion 14*a*.

Numerous features allow male component 10*a* to mate with female component 10*b* to assure uninterrupted fluid transmission. These features include cylindrical portion 12*a* which aligns within lower cylindrical extension 12*b*, receiving portion 14*a* and grooved portion 14*b* and seal members 18*a* which are sized to correspond with receiving channel 18*b*. In the event that all three mechanisms are able to align, one can be assured that fluid transmission is capable of being transmitted without interruption.

Disengagement of male component 10*a* and female component 10*b* may be accomplished in a preferred embodiment by reversing locking member 16*b* and turning it counterclockwise and inserting a cylindrical tool into retractable tabs 20*b* to partially collapse seal member 18*a* to permit removal of male component 10*a*. Locking member 16*b* may alternatively be oriented for engagement when turned counterclockwise and reversed by clockwise rotation. Further, Locking member 16*b* may alternatively be any number of engaging mechanisms that upon activation apply an outward force on first end 21*a* and second end 21*b* sufficiently to expand seal member 18*a* into receiving channel 18*b*.

Figure 3:
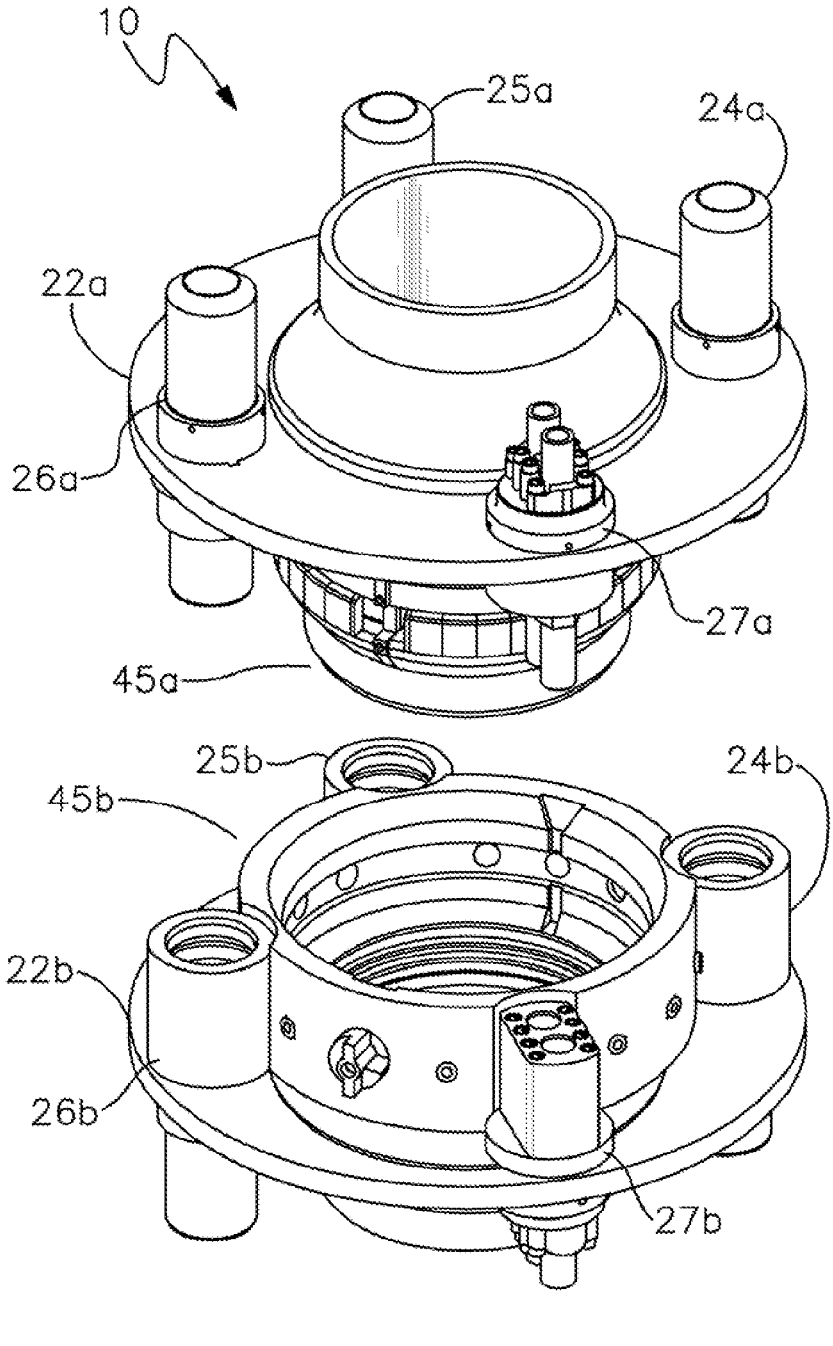
FIG. 3 shows a perspective view of an alternative two part pipe connector according to a preferred embodiment of the invention.

Referring now to FIG. 3, an alternative embodiment of coupling mechanism 10 similar to that depicted in FIG. 1, is illustrated according to another preferred embodiment of the present application. Coupling mechanism 10 includes opposing flange portions 22*a* and 22*b* that are engaged to male member 45*a* and female member 45*b*. Engagement of male member 45*a* and female member 45*b* are identical to that described with coupling mechanism 10 above. Flange portion 22*a* and flange portion 22*b* include opposing pairs of extension mounts 24*a* and 24*b*, 25*a* and 25*b*, 26*a* and 26*b*, along with 27*a* and 27*b*, that are intended to couple various components. Such components include choke likes, "kill" lines, and boost lines for control of various functions present in oilfield operations well known in the art. As is illustrated in the present embodiment, extension mounts 27*a* and 27*b* are formed to couple a plurality of hydraulic lines. Any component that is coupled by one pair of extension mounts may be coupled by another pair of extension mounts. The mating extension mounts are configured for stable engagement and ability to pass through any of a variety of electrical, hydraulic or other control lines as desired.

It will be understood that particular embodiments described herein are shown by way of illustration and not as limitations of the invention. The principal features of this invention can be employed in various embodiments without departing from the scope of the invention. All of the compositions and/or methods disclosed and claimed herein can be made and executed without undue experimentation in light of the present disclosure. Those skilled in the art will recognize, or be able to ascertain using no more than routine experimentation, numerous equivalents to the specific procedures described herein. Such equivalents are considered to be within the scope of this invention and are covered by the claims.

The invention claimed is:

1. A coupling mechanism for engaging two or more annular components comprising:

a) A male component having:

i) a first central annular member;

ii) an extendable seal comprising a plurality of links connected end to end about said annular member said seal having first and second ends;

b) A female component having:

i) a second central annular member;

ii) a receiving slot on an inside diameter of said annular member for said extendable seal;

iii) a rotatable lock that engages said first and second ends for extension of said seal into said receiving slot;

iv) and a plurality of retractable mating tabs in said female component on an outer annulus of said component that reciprocally engages each of a plurality of second receiving slots on the inside diameter of the second central annular member of said female component said tabs capable of selective engagement with a link in said seal.

2. The coupling mechanism of claim 1, the male component and the female component including a first communication member and second communication member which engage in unison with the first male and second female components to facilitate transmission of signals.

3. The coupling mechanism of claim 1, said male and said female components including a set of at least two components for securing one or more transmission lines.

4. The coupling mechanism of claim 1, wherein said extendable seal is composed of interlocking segments.

5. The coupling mechanism of claim 1, wherein said rotatable lock has at least one extension for engaging one end of said seal.

6. The coupling mechanism of claim 1, said male member has an extension tab for reciprocal engagement with a slot on said female member.

7. The coupling mechanism of claim 1 further comprising a plurality of retractable tabs in said female component disposed in said annulus and extended partially on an outside diameter of said female component for engagement with an outer circumference of said seal.

8. A coupling mechanism for engaging two or more annular components comprising:

a) A male component having:

i) a first central annular member, ii) one or more first sub-annular members, and iii) one or more engaging components comprising an interlocking segmented seal;

b) A female component having:

i) a second central annular member;

ii) one or more second sub-annular members;

iii) a rotatable cam that can activate the one or more engaging components; and iv) a plurality of apertures having retractable tabs disposed about the second central annular member;

v) Wherein the male component and the female component can disengage one another via insertion of a member into the one or more apertures to release the female component from the male component.

9. The coupling mechanism of claim 8, wherein the rotatable cam of the female component is activated via rotation of a component disposed about the second central annular member.

10. The coupling mechanism of claim 8, the male component and the female component including a first communication member and second communication member which disengage in unison with the first and second components to cease transmission of signals about the coupling mechanism.

11. The coupling mechanism of claim 8, the first communication member and the second communication member including a set of at least two components for securing one or more transmission lines.

12. The coupling mechanism of claim 8, i) the first central annular member including a series of extension tabs;

ii) the second central annular member including a portion for receiving the series of extension tabs;

iii) wherein the first central annular member and the second central annular member disengage from one another through allowing the extension tabs to be released from the portion for receiving the series of extension tabs.

13. The coupling mechanism of claim 8, the second annular member including a slot for ensuring alignment of the first annular member.

14. The coupling mechanism of claim 8, wherein the sub-annular members align about the circumference of the first and second annular members.

15. A coupling mechanism for engaging two or more annular components comprising:

i) A male annular component having an annulus and an extendable spring comprised of interconnected segments about the outer diameter of said annulus, said spring having first and second ends;

ii) A female annular component for receiving said male member having a receiving slot on an inside diameter of said female annular member for said extendable spring;

iii) a rotatable lock on said female member that engages said first and second ends for extension of said spring into said receiving slot; and iv) a plurality of retractable tabs on said female member that each engages a mating aperture on said female member for engaging the outer circumference of said spring to remove it from said receiving slot.

16. A coupling mechanism as claimed in claim 15 further comprising pass through attachments for communications lines running alongside said annular components.

17. A coupling mechanism as claimed in claim 15 wherein said rotatable lock has at least one extension for engaging said first and second ends.

18. A coupling mechanism as claimed in claim 15 wherein said spring is composed of a plurality of linked segments connected from said first end to said second end.

19. A coupling mechanism as claimed in claim 15 further comprising a V-shaped groove for reception of said tab.

20. A coupling mechanism as claimed in claim 15 further comprising a flange on each of said male and female components for supporting attachment points for communications lines.

* * * * *